US006220948B1

(12) United States Patent
Carballo

(10) Patent No.: US 6,220,948 B1
(45) Date of Patent: Apr. 24, 2001

(54) ADJUSTABLE SANDING DEVICE

(76) Inventor: Edgar Carballo, 14115 NW. 5th Ave., Miami, FL (US) 33168

( * ) Notice: Subject to any disclaimer, the term of this patent is extended or adjusted under 35 U.S.C. 154(b) by 0 days.

(21) Appl. No.: 09/461,221

(22) Filed: Dec. 16, 1999

(51) Int. Cl.[7] ..... B24B 23/00
(52) U.S. Cl. ..... 451/356; 451/495; 451/519
(58) Field of Search ..... 451/356, 442, 451/495, 514, 519, 518, 164

(56) References Cited

U.S. PATENT DOCUMENTS 1,700,114 * 1/1929 Thompson ..... 451/356
1,700,115 * 1/1929 Thompson ..... 451/356
5,464,366 * 11/1995 Hutchins ..... 451/356

* cited by examiner

*Primary Examiner*—Robert A. Rose

(57) ABSTRACT

An attachment for an oscillatory sanding or abrading device has a pair of flexible support members for supporting the sanding or abrading material. The initial radius of curvature of the flexible support member may be adjusted by a spring loaded adjustment mechanism. An opposing pair of circular recesses formed in opposing faces of the flexible sheets allows for replacement of the springs. The recesses can be formed at both ends of the flexible sheets. Adjustment of the initial radius of curvature is accomplished by inserting springs of varying sizes into one or both pairs of recesses. The radius of curvature of the flexible support member during the sanding process is then a function of the spring constant of the spring used and the applied pressure. The device thus uses a series of discrete adjustments each of which covers a range of contoured shapes.

4 Claims, 3 Drawing Sheets

20 – CARVED GUIDANCE HOLES

24 – ADHESIVE SAND PAPER

ADJUSTABLE SANDING DEVICE

BACKGROUND OF THE INVENTION

The present invention relates to sanding and abrading devices. More particularly, it relates to an improved attachment for a sander which allow for adjustably sanding and abrading contoured surfaces.

STATEMENT OF THE PRIOR ART

Various types of sanders and abrading devices have been devised which allow for sanding and abrading contoured surfaces. These types of device are especially useful in the automotive body repair industry, as recent card designs have featured highly contoured, aerodynamic body designs. The majority of these devices are either manual devices or are designed to work with specialized actuators.

U.S. Pat. No. 5,700,187 issued to Balbi discloses a tool for sanding contoured surfaces having means for adjustably controlling the shape of the base to which the sanding material is applied. The adjustment means is relatively rigid and has a fairly complex mechanism, including a pair of screw adjusted journals which may be selectively raised, lowered, or spaced to adjust the curvature of the supporting base. The present invention, by contrast, recognizes that it is virtually impossible to exactly match the contour of any shaped surface. To that end, the present invention uses a plurality of interchangeable springs to adjust the flexible supporting base. The springs can be selectively applied to approximate the shape of the surface to be sanded or abraded. The springs allow the supporting base to conform to the shape of the contoured surface.

U.S. Pat. No. 5,387,251 issued to Rouse discloses another sanding device. The device is an endless belt sanding device which has a triangular frame to which sanding belts may be releasably attached. By contrast, the present invention contemplates a sanding device having a spring loaded support block to which individual sanding sheets may be releasably attached.

U.S. Pat. No. 4,823,515 issued to Blome discloses an adjustable sanding device having a flexible membrane serving as a support surface for an abrasive medium. Opposing edges of the membrane are supported by spaced plates which are selectively positioned to adjust the curvature of the membrane. The present invention contemplates a support for an abrasive medium which has both a flexible membrane and a spring loaded adjustment means allowing the membrane to more fully conform to the contours of the object being sanded or abraded.

None of the above inventions and patents, taken either singly or in combination, is seen to describe the instant invention as claimed.

SUMMARY OF THE INVENTION

The present invention overcomes the disadvantages of the prior art by providing an attachment for an oscillatory sanding or abrading device which has a pair of flexible support members for supporting the sanding or abrading material. The initial radius of curvature of the flexible support member may be adjusted by a spring loaded adjustment mechanism. An opposing pair of circular recesses formed in opposing faces of the flexible sheets allows for replacement of the springs. The recesses can be formed at both ends of the flexible sheets. Adjustment of the initial radius of curvature is accomplished by inserting springs of varying sizes into one or both pairs of recesses. The radius of curvature of the flexible support member during the sanding process is then a function of the spring constant of the spring used and the applied pressure. The device thus uses a series of discrete adjustments each of which covers a range of contoured shapes.

Accordingly, it is a principal object of the invention to provide a new and improved attachment for sanding and abrading devices which allows for sanding and abrading contoured surfaces.

It is an object of the invention to provide a new and improved attachment for sanding and abrading devices which has a layered flexible support member for supporting the sanding or abrading material.

It is an object of the invention to provide a new and improved attachment for sanding and abrading devices which has a spring loaded support mechanism for adjusting for the contour of the surface to be sanded.

It is an object of the invention to provide a new and improved attachment for sanding and abrading devices having interchangeable springs of varying heights for adjusting the radius of curvature of the sanding material.

It is an object of the invention to provide a new and improved attachment for sanding and abrading devices having springs of varying spring constants for adjusting the flexibility of the support mechanism for the sanding and abrading material.

It is an object of the invention to provide a new and improved attachment for sanding and abrading devices having a plurality of discrete adjustments each of which allow for sanding a range of contoured surfaces.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
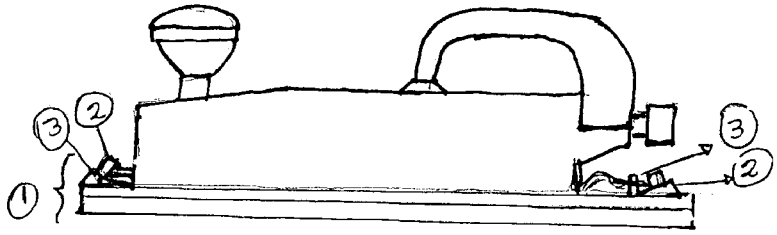
FIG. 1 shows a side view of an attachment for automatic sanding and abrading tools attached to a sander.
Figure 2:
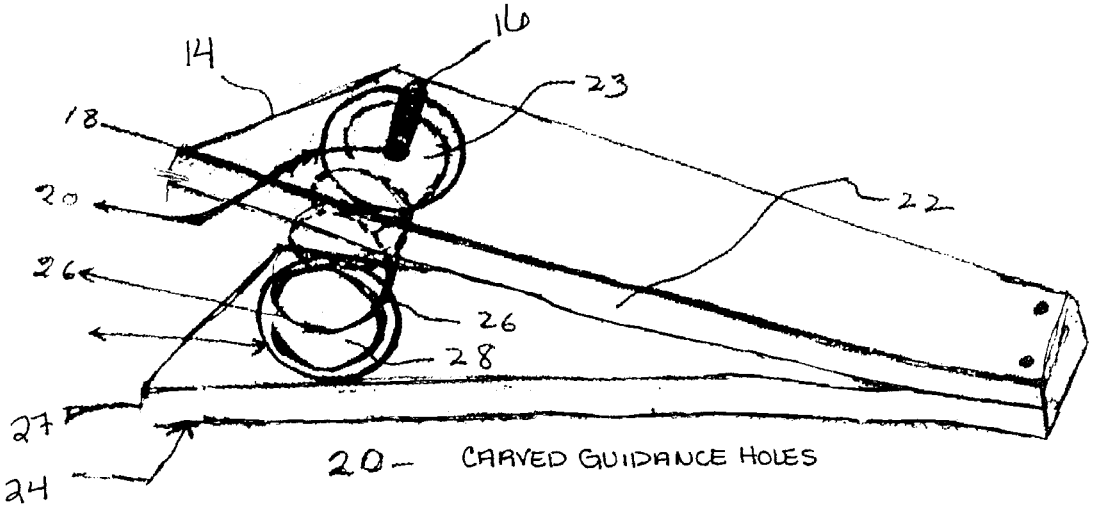
FIG. 2. shows a perspective view of the attachment, partly in section.
Figure 3:
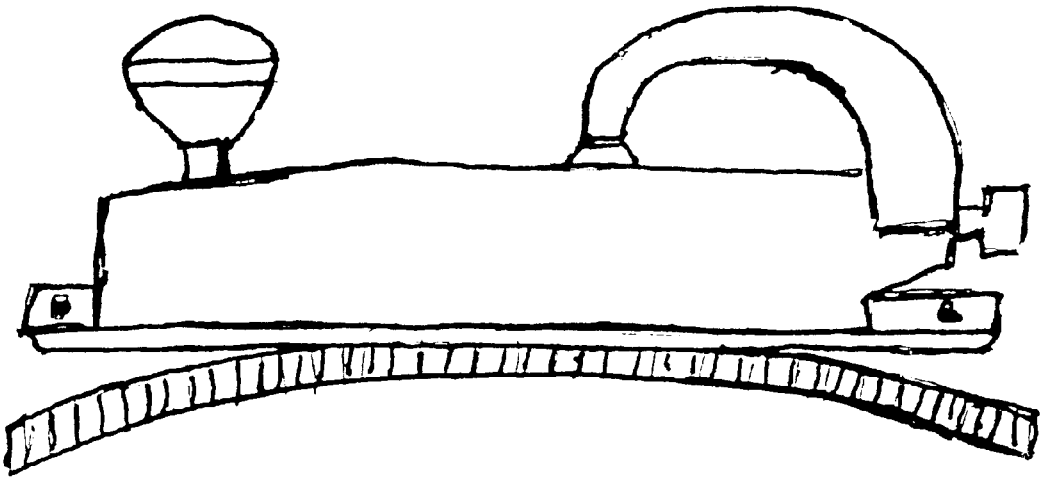
FIG. 3. shows a side view of the attachment in one of several discrete positions attached to a sander.

Referring now to FIGS. 1–4, a sanding and abrading machine attachment formed in accordance with a first embodiment of the present invention, generally indicated by the numeral 10, is shown. The attachment 10 is adapted for use with a handheld pneumatic or other self powered sander 12 having a flat bed (not shown) which is moved in a longitudinal or orbital path at a relatively high speed. These sanders 12 typically have a single flat bed with means for selectively releasing/securing strips of sanding material to be applied to a workpiece. Sanding contoured surfaces is typically done with some difficulty even by professionals, the results obtained thereby are mot always satisfactory and even in the event they are, much time is consumed in the process. To that end, the attachment 10 of the present invention is provided to facilitate sanding of contoured surfaces with superior results while minimizing the time spent by the worker.

The attachment 10 includes a lower portion and an upper portion, the upper portion comprising a flexible layered base 14 with the attachment 10 being used in place of the flat bed. Screws 16 disposed at opposing ends of the base 14 allow for connecting the attachment 10 to the sander 12. The aluminum sheet 18 is secured to the sander mechanism in place of the flat bed. The aluminum sheet 18 has corresponding threaded apertures 20 formed therein for receiving the screws 16 which extend into threaded apertures 21 in the sander 12. An adhesive rubber pad 22 secured to the aluminum sheet 18 has at least one recess 23 formed therein for removably receiving at least one spring 26 as will be explained in more detail later.

The lower portion of the attachment contains the sanding or abrading material 24 which is preferably attached using an adhesive. Preferably the sanding material 24 has an adhesive backing. A support layer 27 for the sanding material 24 may be made of a relatively hard but flexible plastic material that can be easily curved into a desired shape by springs 26. The support layer 27 has at least one recess 28 aligned axially with and opposing recess 23, the recess 28 sized for removably receiving the opposite end of spring 26.

Figure 4:
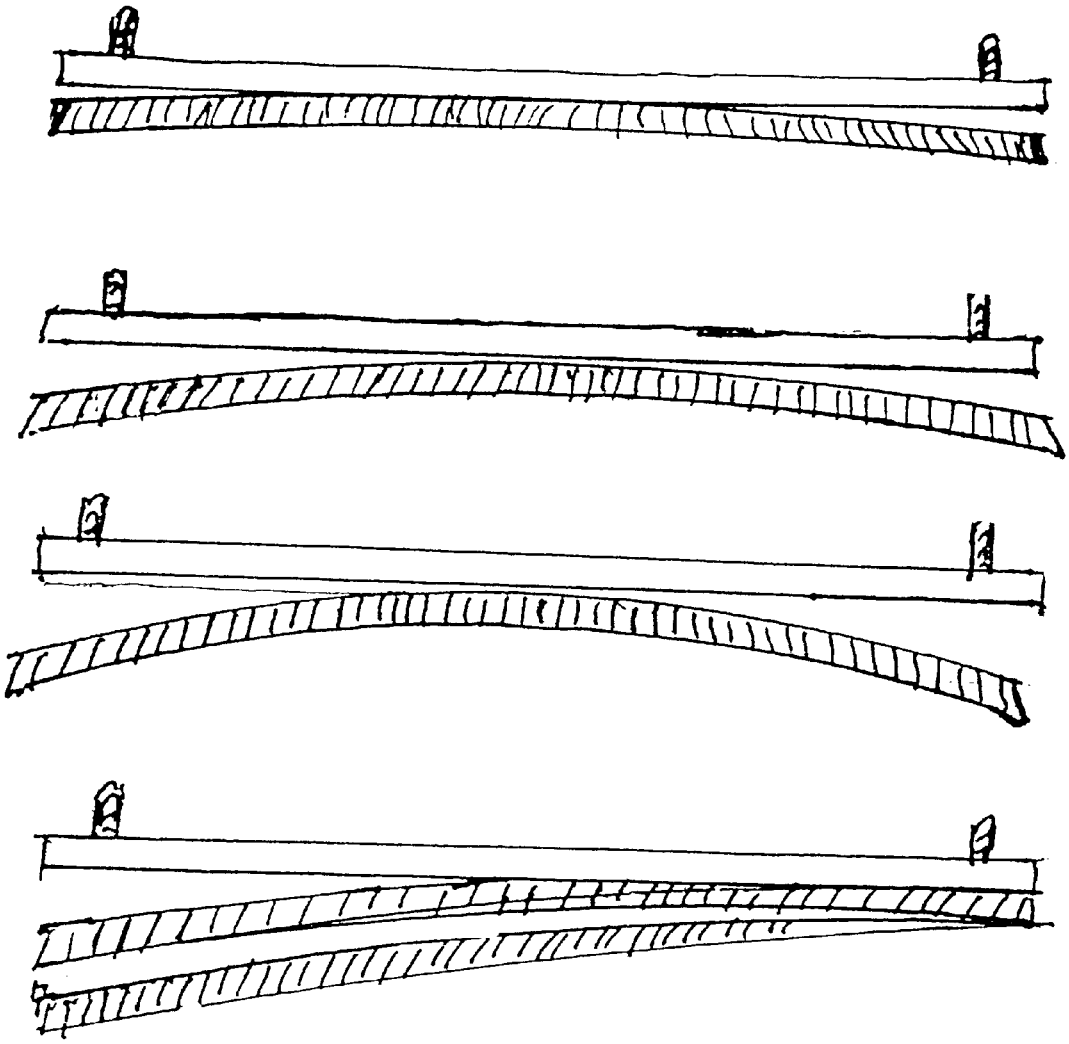
FIGS. 4*a*–4*d* show several different positions of the attachment illustrating the changes in the radius of curvature of the sanding material.

The adjustment of the curvature is brought about by adjusting the thickness or height of the springs 26. A series of springs 26 sized to fit within recesses 23, 28 allow for a plurality of discrete curvatures. One sided curvature as shown in FIG. 4(*d*) is accomplished by inserting spring 26 into recesses 23, 28 on only one side of the layers 14, 27. Two sided curvature is effected by inserting springs 26 into recesses on both sides of the layers as is shown in FIG. 4(*c*). The structure is designed for easy replacement of the springs 26 which may be contracted for removal and replacement. During replacement the user must take care to ensure that the spring 26 is positioned entirely within the recesses 23, 28.

In operation, the existing oscillating bed of the sander 12 is replaced with the attachment 10 of the invention. Once the approximate contour of curvature of the surface to be sanded is determined, the curvature of support layer 27 is adjusted to match using springs 26. The springs may be removed by pulling on the support layer 27 until the spring is easy to move. Care must be taken to avoid using too much force when pulling on support layer 27 to avoid damaging the support layer. Once the appropriate curvature is attained the sander 12 may then be used in the usual manner. The spring constant or stiffness of the springs 26 allow for the curvature of the support layer 27, and therefore the sanding or abrading material 24 to conform to the contour of the working surface while the sander 12 is applied to the working surface with downward pressure. Unlike prior art adjustable sanders which use rigid mechanisms set to a predetermined curvature, the present invention contemplates a structure which allow first for approximation of the contour to be sanded, then the application of pressure can be used to more fully approximate the contour of the surface to be sanded, such approximations to be made within a predetermined discrete setting. If it is desired to limit the flexure of the support layer 27, springs 26 having a higher spring constant may be used. Conversely, when sanding a surface having many undulations it may be desired to have a greater flexure. This is accommodated by employing springs 26 having a lower spring constant. Once the worker is familiar with the characteristics of the support layer under a wide variety of operating conditions, substitution of the appropriate springs 26 to meet various conditions is easily accomplished.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A pneumatic sanding apparatus having a bed to which a sanding or abrading material may be attached, said sanding apparatus including an attachment including a plurality of interchangeable springs, the attachment secured to said bed by an attachment means extending from a main body of the sanding apparatus, said attachment comprising:

a generally rectangular aluminum sheet removably attached to said attachment means and having threaded boreholes formed therein for accepting a pair of screws, said boreholes disposed proximate opposing short ends of said aluminum sheet;

a first flexible pad secured to said aluminum sheet and having at least a first recess formed therein;

a second flexible pad having an adjustable radius of curvature, an interior face opposing said first flexible pad, and an exterior face, said second flexible pad having at least a second recess formed therein, said first and second recesses axially aligned;

at least one of said interchangeable springs removably attached between said first flexible pad and said second flexible pad, opposing ends of said spring situated within said first and second recesses;

the exterior face of said second flexible pad having said abrading material secured thereto;

whereby said radius of curvature may be adjusted by inserting springs of various sizes between said first and second flexible pads in said first and second recesses.

2. The apparatus of claim 1 wherein said first and second pads have both first and second recesses formed therein at opposing ends thereof.

3. The apparatus of claim 2 wherein one sided curvature is effected by inserting a single one of said springs between said first and second flexible pad.

4. The apparatus of claim 2 wherein two sided curvature is effected by inserting two of said springs between said first and second flexible pad.

* * * * *